US006155166A

United States Patent [19]

Bertagna et al.

[11] Patent Number: 6,155,166

[45] Date of Patent: Dec. 5, 2000

[54] ROTOGRAVURE PRINTING AND COATING MACHINE

[75] Inventors: Luigi Bertagna, Verona; Mauro Cattaruzza, Thiene; Agostino Pertile, San Martino Buon Albergo, all of Italy

[73] Assignee: Uteco S.p.A. Roto-Flexo & Converting Machinery, Colognola Ai Colli, Italy

[21] Appl. No.: 09/240,834

[22] Filed: Feb. 1, 1999

[30] Foreign Application Priority Data

Feb. 5, 1998 [IT] Italy ..... VR98A0008

[51] Int. Cl.[7] ..... B05C 1/00; B41F 9/00; B41F 7/00; B41F 31/00

[52] U.S. Cl. ..... 101/153; 118/212; 101/150; 101/349.1

[58] Field of Search ..... 101/150–153, 101/348, 349.1, 216, 219, 174, 178, 248; 118/212

[56] References Cited

U.S. PATENT DOCUMENTS

| | | | |
|---|---|---|---|
| Re. 34,483 | 12/1993 | Bowman et al. | 101/138 |
| 2,212,820 | 8/1940 | Barber | 101/247 |
| 3,625,145 | 12/1971 | Heatley, Jr. et al. . | |
| 3,736,869 | 6/1973 | Motter et al. | 101/153 |
| 3,738,265 | 6/1973 | Saueressig | 101/152 |
| 3,783,782 | 1/1974 | Hardt | 101/216 |
| 3,894,488 | 7/1975 | Gazzola et al. . | |
| 3,900,812 | 8/1975 | Brewer | 338/2 |
| 4,046,070 | 9/1977 | Halley | 101/216 |
| 4,057,012 | 11/1977 | Heidemann | 101/153 |
| 4,239,001 | 12/1980 | Kataoka | 101/152 |
| 4,704,296 | 11/1987 | Leanna et al. . | |
| 4,852,515 | 8/1989 | Terasaka et al. | 118/663 |
| 5,275,656 | 1/1994 | Jendroska . | |
| 5,528,986 | 6/1996 | Andersson et al. | 101/219 |
| 5,740,736 | 4/1998 | Toyoda | 101/218 |

FOREIGN PATENT DOCUMENTS

| | | |
|---|---|---|
| 0 396 904 | 11/1990 | European Pat. Off. . |
| 44 20 771 | 1/1995 | Germany . |

*Primary Examiner*—Kimberly Asher
*Attorney, Agent, or Firm*—Guido Modiano; Albert Josif; Daniel O'Byrne

[57] ABSTRACT

A machine for printing or spreading primers or coatings and the like with direct and indirect rotogravure system, comprising one or more printing or color units, with a respective drying hood and control unit, each printing or color unit comprising an orientatable inlet roller for tape material, a plurality of free rollers for conveying the tape material, an upper pressure roller, provided with a rubber sleeve, a lower pressure roller, a doctor blade, and an engraved cylinder. At least one roller, chosen between the upper pressure roller and the lower pressure roller, is rotated by a respective step motor and recirculating ballscrews and is supported on linear guides at its ends, with interposed pressure detecting means arranged to forward to the control unit signals indicating the linear pressure between the upper pressure roller and the lower pressure roller and the engraved cylinder.

16 Claims, 11 Drawing Sheets

28
27
29
31
32
34
35
25
4
3
20
21
14
24
13
23
12
19
II
II
32
31
1
26
5
17
16
15
18

ROTOGRAVURE PRINTING AND COATING MACHINE

BACKGROUND OF THE INVENTION

The present invention relates to a printing and/or coating or lacquering machine with direct and indirect rotogravure system.

As it is known, in the rotogravure printing it is very important to accurately control the contact pressure between the pressure roller or cylinder and the engraved cylinder or roller, because print quality largely depends on such a control. The most advanced systems used so far are of pneumatic type, but they make it possible to obtain only a coarse indication, so to speak, of the working pressure. Furthermore, since pneumatic systems are rather resilient, they are subject to oscillate even if provided with a damping chamber, which negatively affects the final printing results.

SUMMARY OF THE INVENTION

The main object of the present invention is to provide a printing or coating machine with a rotogravure system, provided with a device which is designed precisely to control the contact pressure between the lower pressure roller and the engraved cylinder in the case of direct rotogravure printing, and accurately to control pressure between the upper pressure roller and the lower pressure roller and between the lower pressure roller and the engraved cylinder in the case of indirect rotogravure printing.

Another object of the present invention is to provide a printing and/or coating machine with a rotogravure system which makes it possible to obtain zero contact pressure or a minimal gap (of the order of 0.01–0.5 mm), which is very convenient when coating with lacquers or paints, in which case the engraved cylinder is rotated in the opposite direction with respect to its respective pressure roller.

Another object of the present invention is to provide a contact pressure control device which makes also possible to perform pre-measurements with initial reading of the diameter of the rubber sleeves of the lower and upper pressure rollers.

Another object of the present invention is to provide a rotogravure printing machine which is provided with a new inking assembly for high-quality inking.

Another object of the present invention is to provide a rotogravure printing machine which is provided with a carriage for supporting and transferring an engraved cylinder, a doctor blade and an inking assembly.

These and other objects which will become better apparent hereinafter are achieved by a printing or spreading or coating or lacquering machine with direct and indirect rotogravure system, having one or more printing or color units, a drying hood and a control unit, each printing or color unit comprising an orientatable inlet roller for material in ribbon or tape form, a plurality of idle rollers for conveying the tape material, an upper pressure roller provided with a rubber sleeve, a lower pressure roller, a doctor blade assembly, an engraved cylinder, characterized in that at least one roller, chosen between said upper and said lower pressure rollers, is vertically movable and can be actuated by a pair of step motors and recirculating ballscrews and is supported so as to be movable along linear guides at the ends of the recirculating ballscrews, with the interposition of pressure detection means arranged to report to the control unit the linear pressure between the upper pressure roller and the lower pressure roller and between the lower pressure roller and the engraved cylinder.

BRIEF DESCRIPTION OF THE DRAWINGS

Further aspects and advantages of the present invention will become apparent from the following detailed description of a specific currently preferred embodiment thereof, given merely by way of non-limitative example with reference to the accompanying drawings, wherein.

In the accompanying drawings, identical or similar parts or components have been designated by the same reference numerals.

DESCRIPTION OF THE PREFERRED EMBODIMENTS

Figure 1:
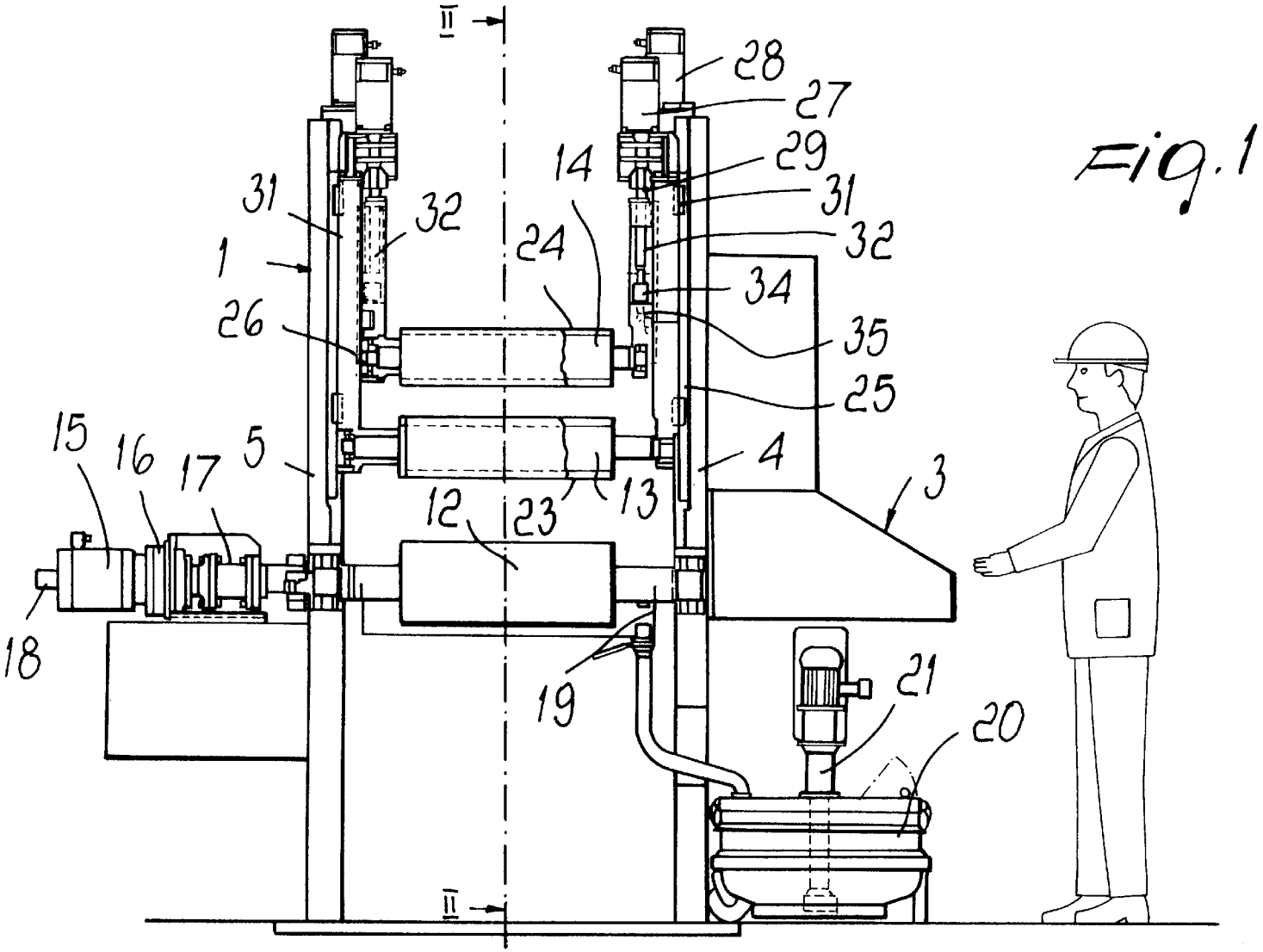
FIG. 1 is a diagrammatic elevation view, with parts shown in cross-section, of a rotogravure printing element or station.
Figure 2A:
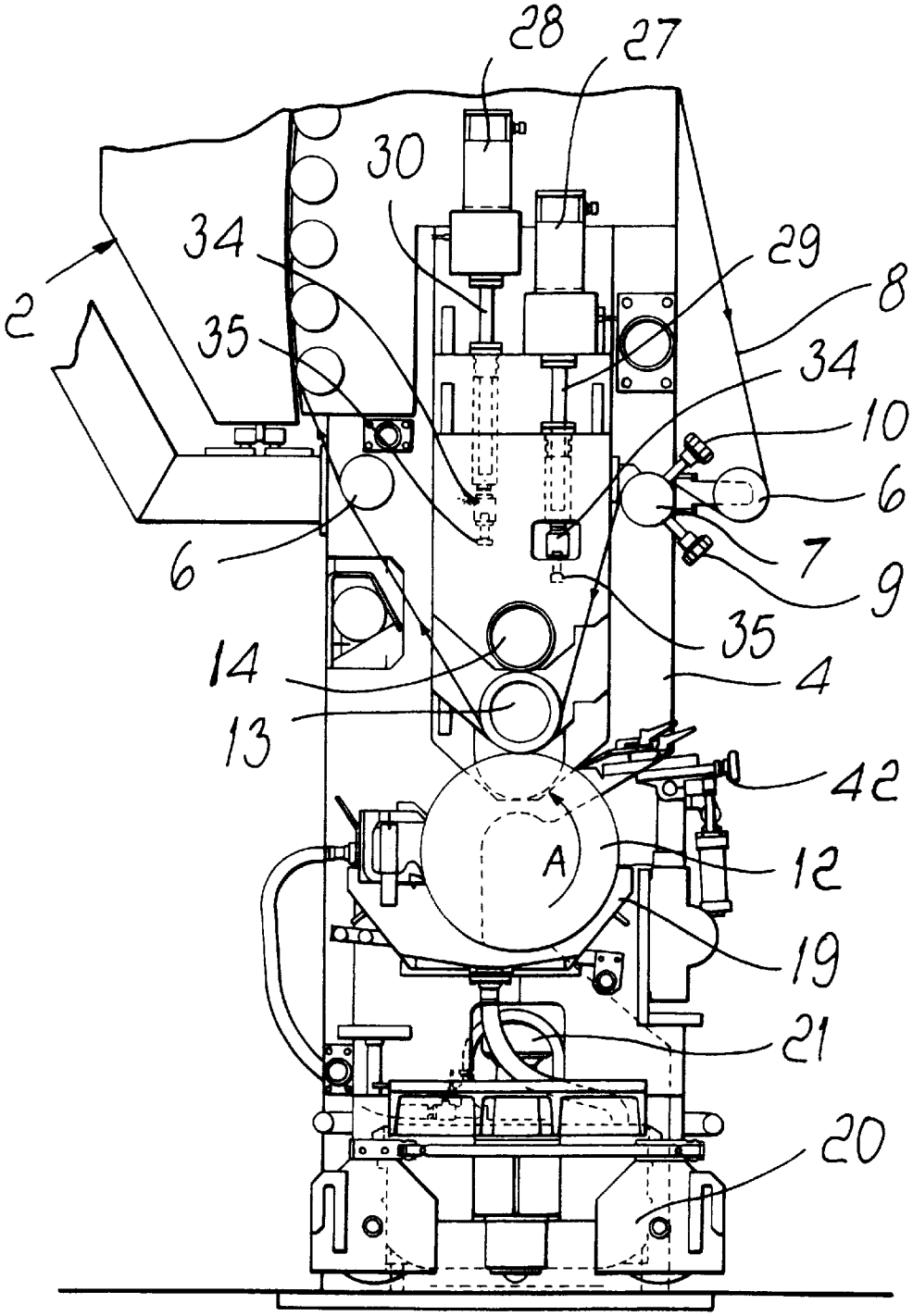
FIG. 2A is a cross-sectional view taken along the line II—II of FIG. 1 of a carriage or truck for supporting the engraved cylinder arranged for printing according to a direct rotogravure system.
Figure 4:
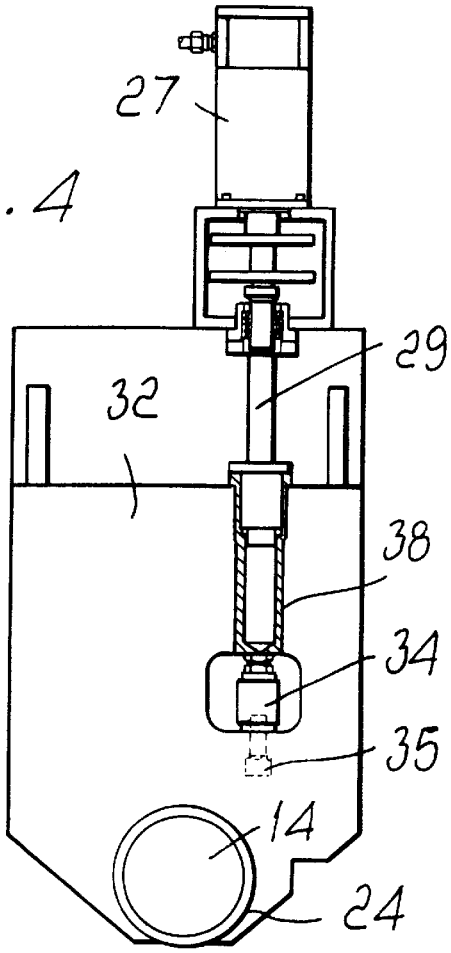
FIG. 4 is an enlarged-scale view of a detail of FIGS. 2 and 3 showing the connection between the recirulating ballscrew and its respective load cell.
Figure 2B:
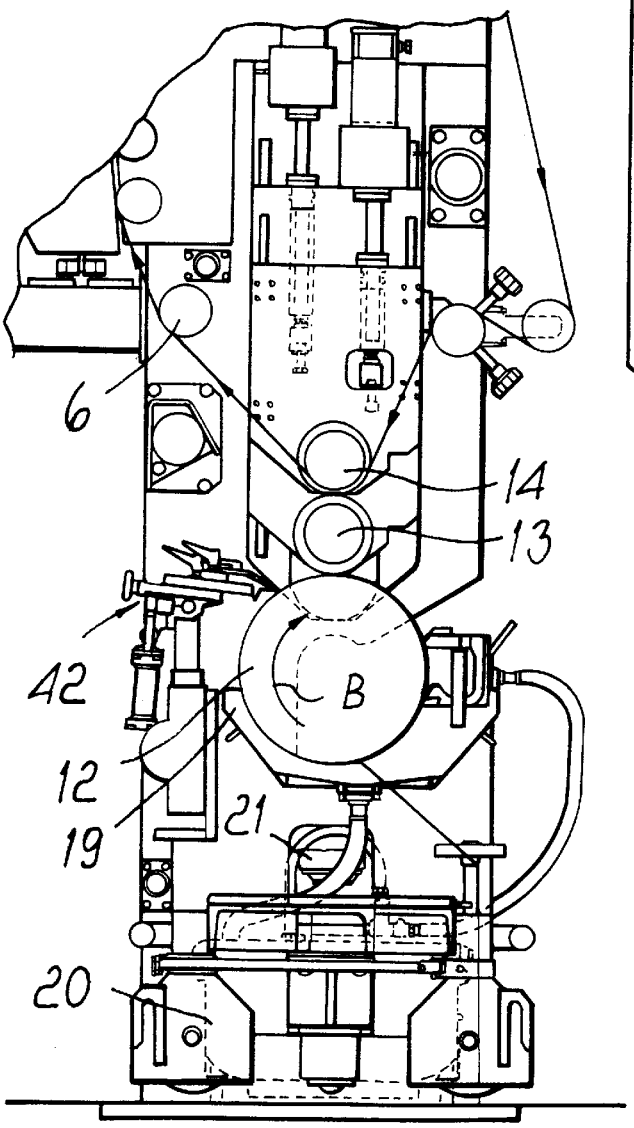
FIG. 2B is similar to FIG. 2A, but with carriage or truck for supporting the engraved cylinder arranged for printing according to an indirect rotogravure system.

With reference first to FIGS. 1 to 4, it is clearly shown that a printing unit or station in a rotogravure printing machine of multiple-color type, for example of the eight-color type, generally designated by the reference numeral 1, is constituted substantially by a printing assembly, a drying hood 2 and a control panel or unit 3.

The printing assembly comprises two lateral shoulders, i.e. a shoulder 4 on the front side of the machine and a shoulder 5 on the rear side, on which idle rollers are mounted sequentially (only one of the rollers, designated by the reference numeral 6, is shown in the drawings. See FIGS. 2A, 2B and 3) together with an adjustable roller 7 which is arranged at the infeed of the material in ribbon or tape form 8 to be printed and can be adjusted micrometrically at both ends thereof, as shown schematically by two screws 9 and 10 in FIGS. 2A and 2B. An engraved cylinder (spreader roller) 12 is also supported on the lateral shoulders 4 and 5 together with a lower pressure roller 13 for transferring ink during printing and an upper pressure roller 14.

For printing or coating or lacquering with a direct rotogravure system, the engraved roller 12 is rotated in the direction of the arrow A (FIG. 2A), i.e., in the feed direction of the ribbon 8, whereas with the indirect rotogravure system it is rotated in the direction of the arrow B (FIG. 2B), i.e., against the feed direction of the ribbon 8 to be printed or coated or lacquered.

The engraved cylinder 12 (see FIGS. 1, 2A and 2B) is driven by an electric motor 15 with the interposition of an epicyclic reduction unit 16, a coupling 17 and an encoder 18, which is connected in axial alignement with the driving shaft. The engraved cylinder 12 can rotate in both directions and its motor 15 performs both the continuous rotation function, when the machine 1 is at rest as well as the function of orientating the roller in the home position for its on-off engagement and register pre-set. The engraved cylinder 12 and the pressure rollers 13 and 14 are moved away automatically, e.g. by approximately 2 mm, from one another every time the machine stops.

As usual, below the engraved cylinder 12 there are provided an ink tray 19, a tank 20 and an electric pump 21 for ink feeding and circulation (see FIG. 1 in particular).

Both the lower pressure roller 13 and the upper pressure roller 14 have a respective rubber sleeve 23 and 24 (see FIG. 1), which is approximately 2 mm thick and can be easily replaced between the engraved cylinder 12 and the pressure rollers simply by being laterally inserted and extracted manually with compressed air e.g. at 16 bar, through a suitable opening provided in the lateral shoulder 4, whereas its respective cylindrical core 13 and 14 is kept in the machine. The pressure rollers are rotatably mounted on self-aligning bearings which are fixed on slides which can slide on linear recirculating ballscrew guides 25 and 26 which are vertically secured inside the lateral shoulders 4 and 5. The position of the rollers 13 and 14 along the guides 25 and 26 (see FIG. 1) is controlled by step motors 27 and 28 which operate respective recirculating ballscrews 29 and 30 kinematically connected to supporting slides 31 for the lower pressure roller 13 and 32 for the upper pressure roller 14. The position of the screws 29 and 30 is controlled by an encoder which is located on the rear of the step motor in axial alignment with said recirculating ballscrews.

In order to precisely control the linear pressure applied by the step motors 27 and 28 (see FIG. 1), between the upper pressure roller 14 and the lower pressure roller 13 and between the lower pressure roller and the engraved cylinder 12, there are provided load cells 34, preferably of the explosion-proof type operating with electric-resistor strain-gauges. At both sliding blocks of the machine the load cell 34 is rigidly secured to the nut of the recirculating ballscrew by means of a cup-shaped sleeve 38, whereas the sliding blocks 31 and 32 supporting the pressure rollers 13 and 14 are suspended to the load cells 34 by means of a screw 35 (see FIG. 4).

Of course it is also possible to use other suitable pressure detection means, e.g. piezometric sensors or the like, instead of the load cells.

Typically, the linear pressure between the rollers can change between 3 and 30 N/cm and can be controlled and monitored with high accuracy at any stage of the printing process. The lower pressure roller 13 and the upper pressure roller 14 are positioned automatically and the value of the pressure set in the PLC at the control unit 3 is automatically attained during the first intervention of the pressure rollers actuated by the step motors 27 and 28.

It is also possible to perform through a program a pre-measurement of the diameters of the pressure rollers 13 and 14 and the initial diameters of the rubber sleeves also to detect, while printing, the extent of the wear of said rubber sleeves, thereby ensuring high printing quality in any circumstance.

Figure 5:
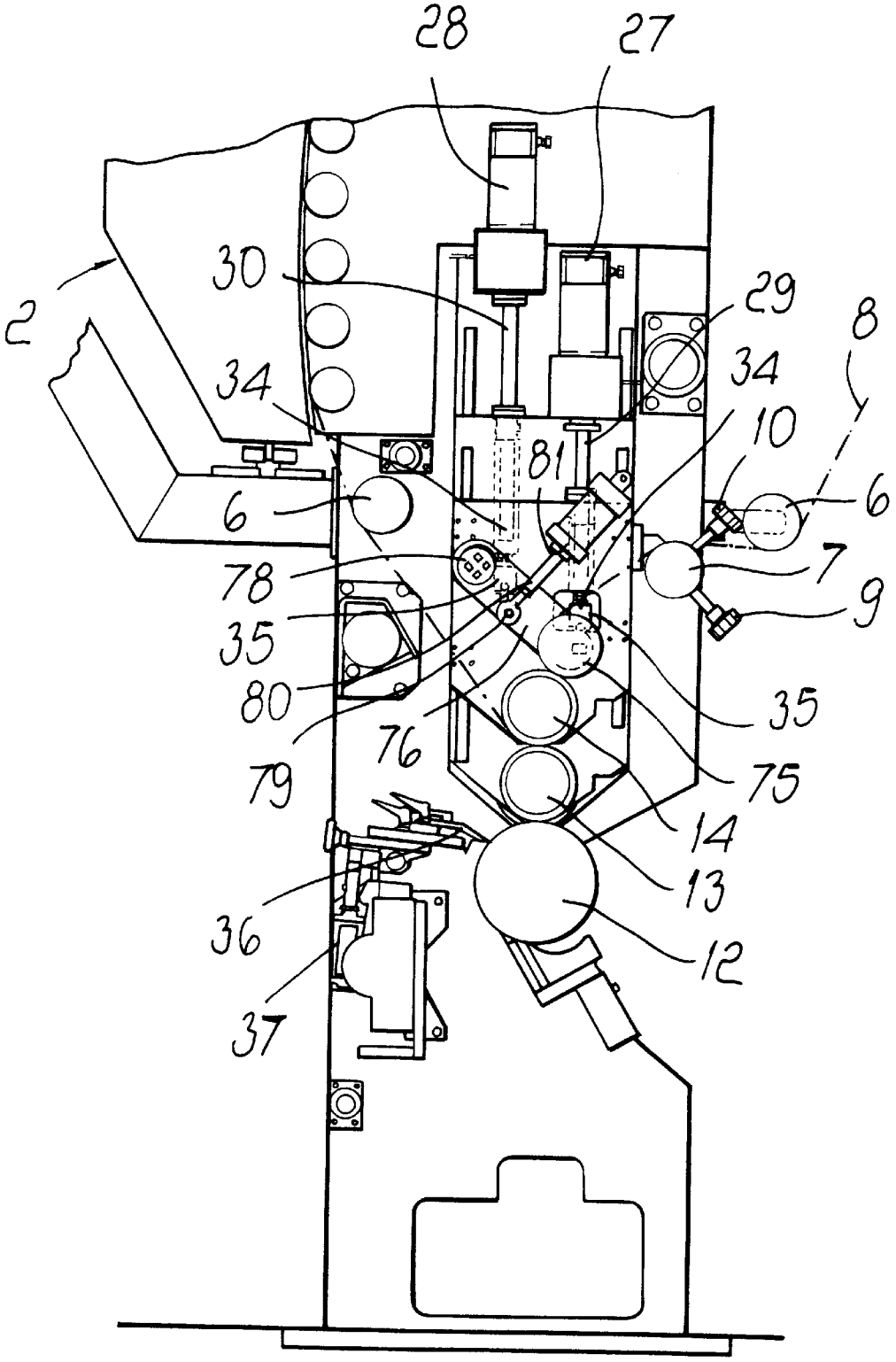
FIG. 5 is a vertical sectional view, taken along the line V—V of FIG. 6, of the front shoulder of a printing station provided with an auxiliary pressure roller.
Figure 6:
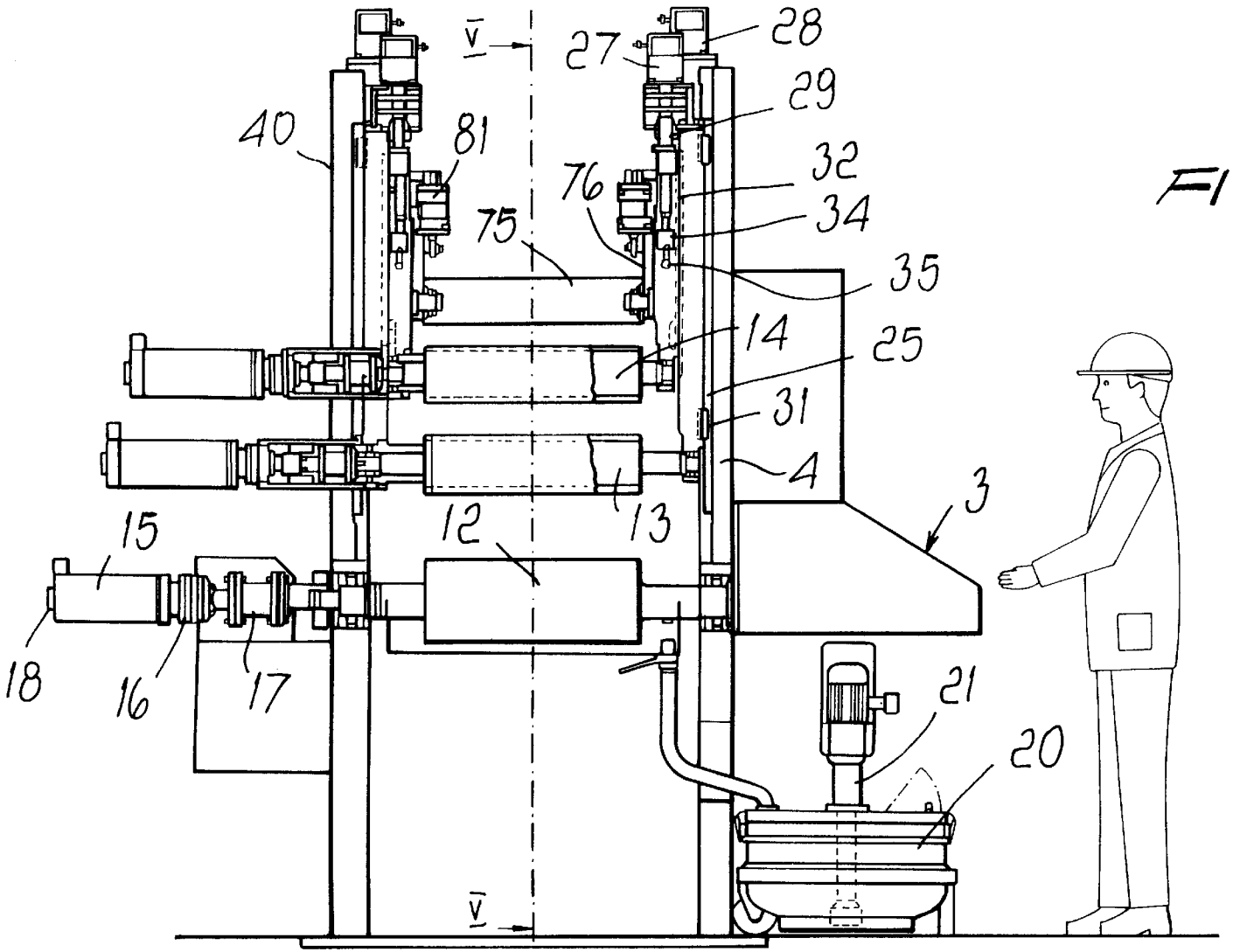
FIG. 6 is an elevation view with parts shown in cross-section of a printing or coating station provided with an auxiliary pressure roller for effectively gripping the tape material.

FIGS. 5 and 6 show a spreading or coating station 40 provided with an auxiliary pressure roller 75 which is mounted at one end of a pair of identical arms 76, whose other end is pivoted about a horizontal pivot 78 which extends parallel to the axes of the rollers 13 and 14. The end of a stem 80 is pivoted at 79 to an intermediate point of the arms 76. Said stem 80 belongs to a respective pneumatic cylinder-and-piston assembly 81 arranged to press the auxiliary pressure roller 75 against the upper pressure roller 14, so that it forms together with the pressure roller 14 a composite traction assembly which assists in ensuring constant tension of the ribbon or tape material to be printed.

The lower pressure roller 13 and the upper pressure roller 14 are operated independently from one another by a respective electric motor, thereby making it also possible to rotate the two rollers in opposite directions. This is particularly advantageous for the application of primers with a "kiss-coating" effect in order to remove the primer ink excess with a contactless process. Thus, it is possible to apply a thicker or thinner layer of primer depending upon the rotation speed in opposite directions of the rollers 13 and 14. The automatic back movement of the rollers every time the machine stops is about 2 mm, whereas it is approximately 100 mm for a color changing.

A positive doctor blade 36 is provided on the engraved cylinder 12 and arranged to eliminate the ink in excess. The doctor blade can be actuated by two pneumatic cylinder-and-piston units 37 which are controlled by the control unit 3.

Figure 3:
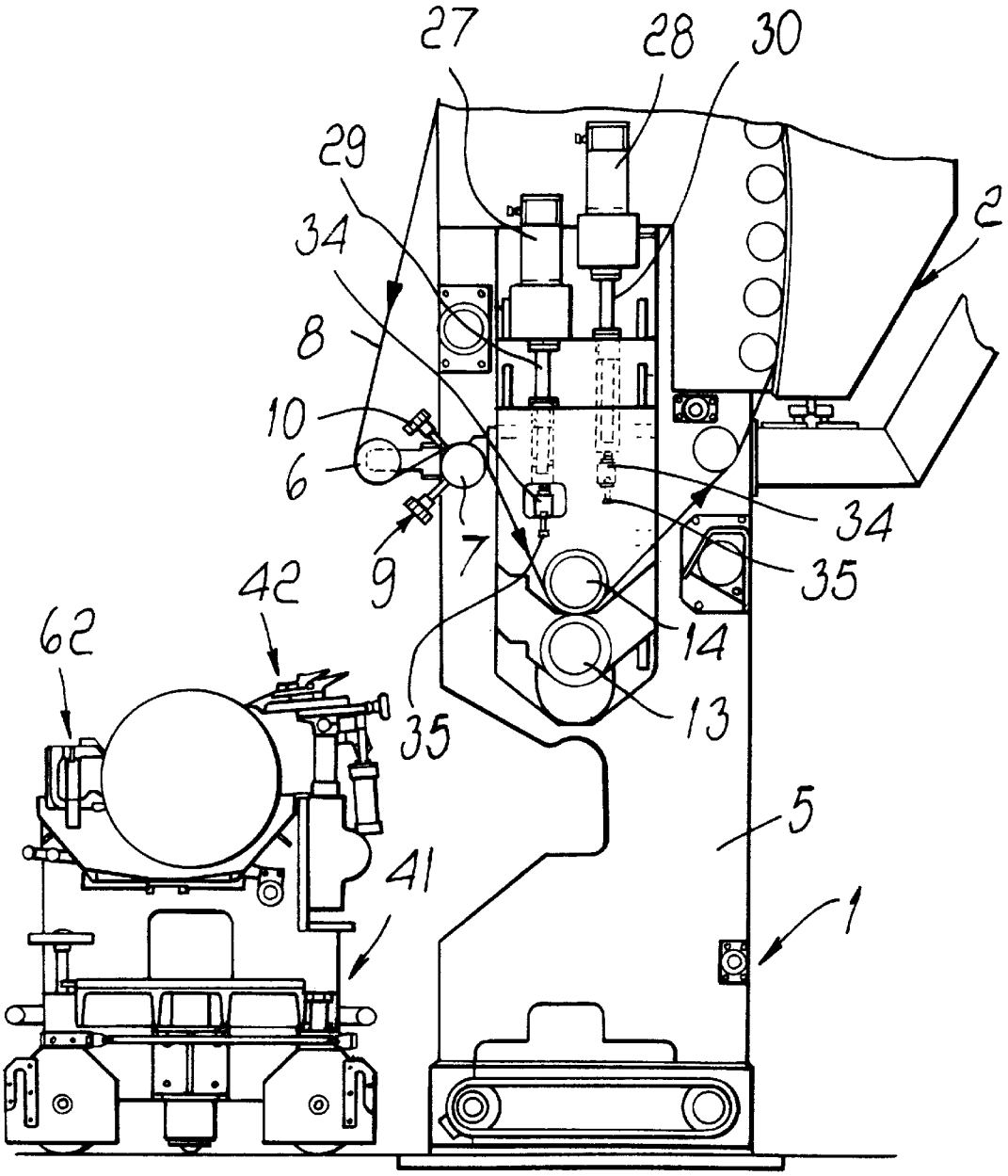
FIG. 3 is a view similar to FIG. 2 but showing the opposite lateral shoulder of a printing element or station and of the lower part of said lateral shoulder, where an on-off carriage or truck is provided.

FIGS. 1 to 3 relate to a printing element or station 1 provided with a carriage or truck 41 which can be inserted into and removed from it. A priming station comprises a rotogravure printing unit, e.g. that described with reference to FIGS. 5 and 6, where no carriage 41 is provided.

Figure 7:
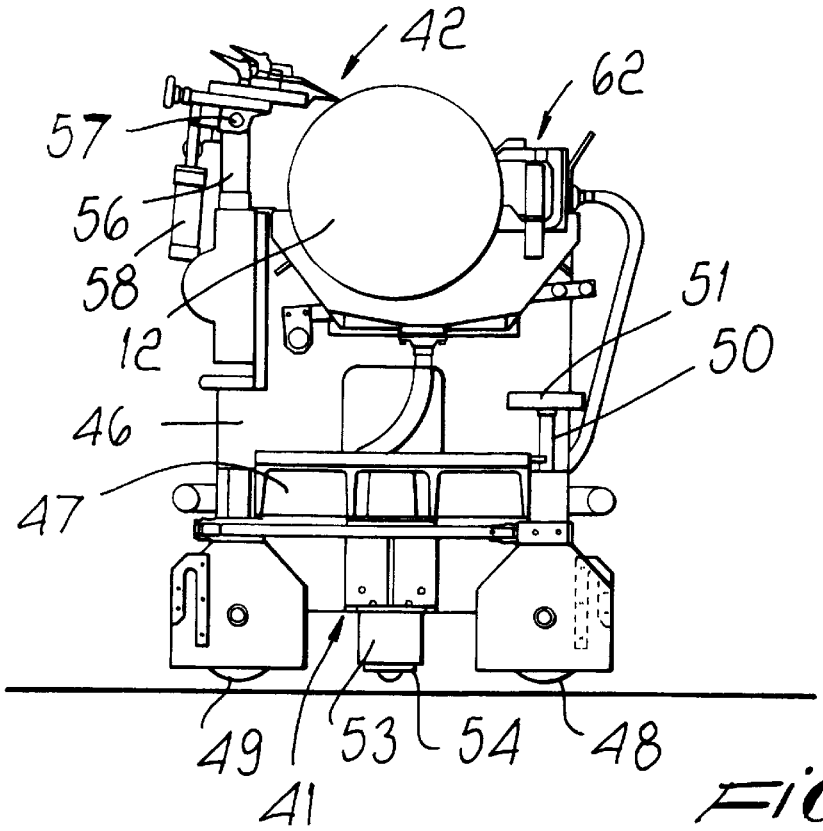
FIG. 7 is a side elevation view of an on-off carriage or truck for supporting an engraved cylinder, a doctor blade and an inking system which can be applied as shown in FIGS. 2B and 3.
Figure 8:
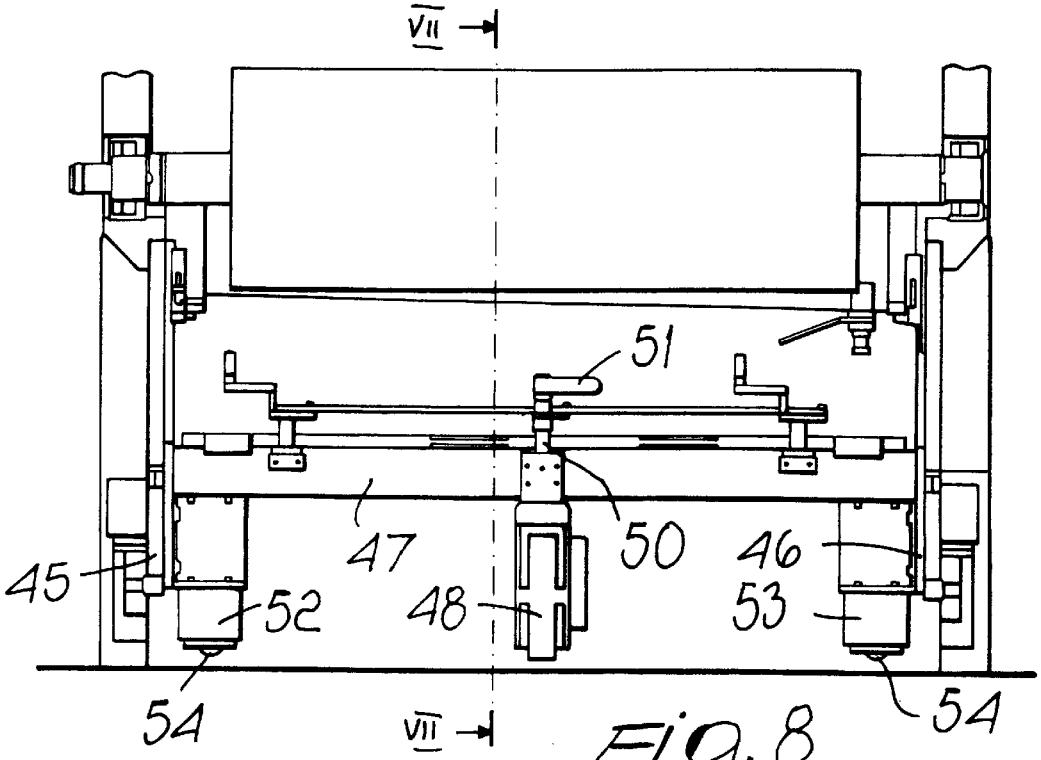
FIGS. 8 and 9 are, respectively, a front and a plan view of the carriage or truck of FIG. 7.
Figure 9:
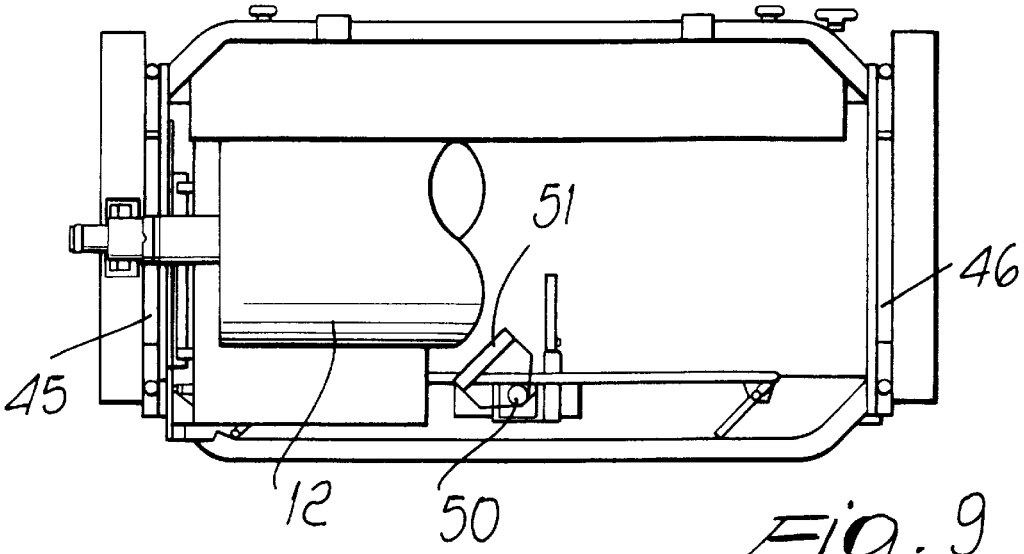

The carriage or truck 41 (FIGS. 7 to 14) comprises a supporting structure, and a doctor blade 42 and an engraved printing cylinder 12 both supported by the supporting structure. The supporting structure comprises, for example, two side shoulders 45 and 46, e.g. made of steel, which are mutually rigidly connected by a cross-member 47, to which two steerable wheels, i.e. a front wheel 48 and a rear wheel 49, are secured to and along the transverse centerline of the carriage. Said wheels can be steered manually by means of a steering column 50 and a handle 51 (FIGS. 7 and 8).

Close to each side shoulder there is provided at the longitudinal centerline of the carriage a false leg 52 and 53 which terminates at its lower end with a respective free ball 54 which is located however, at a slightly higher level (e.g. approximately 5 mm) shorter than the wheels 48 and 49 (see FIG. 7), thereby ensuring easy manual handling in all directions and great versatility of the carriage 41.

The doctor blade assembly 42 is mounted on lateral slides 56 which can move along vertical guides for vertical mechanical adjustment of the entire doctor blade assembly. The doctor blade is actually mounted so that it can be angularly adjusted about a horizontal pivot 57 upon control of one or more pneumatic cylinder-and-piston units 58 with quick locking of the doctor blade.

An ink tray 60 (see FIG. 13), preferably made of stainless steel, is supported vertically adjustable (up-down) below the cylinder 12 and has an ink outlet 61 leading directly into a tank located outside the printing assembly. The tray can be easily vertically adjusted and quickly replaced.

In front of the doctor blade 42, on the opposite side with respect to the printing cylinder 12, there is an inking assembly 62 which comprises a nipple 63 (see FIG. 13) which constitutes the inlet for any ink supplied by a pump sucking from a tank located outside the printing assembly. The inking assembly 62 is arranged to form an ink film in order to fill the engravings of the printing cylinder, thereby preventing any residual ink from drying after the transfer of the print to the ribbon or tape. Preferably, inking should take place along the highest possible generatrix of the printing cylinder, so as to minimize the time in which any residual ink is exposed to the air. The inking assembly 62 is adjustably mounted on horizontal guides 64 in order to match various diameters of the printing cylinder 12.

The best inking operation is ensured at the level of the ink column, i.e. at approximately 120 mm, since the pressure on the surface of the engraved cylinder 12 is increased accordingly. The shape of the peripheral inking assembly is preferably suitable to produce considerable turbulence, which maintains the ink in continuous motion in order to dissolve any clots in it.

Figure 10:
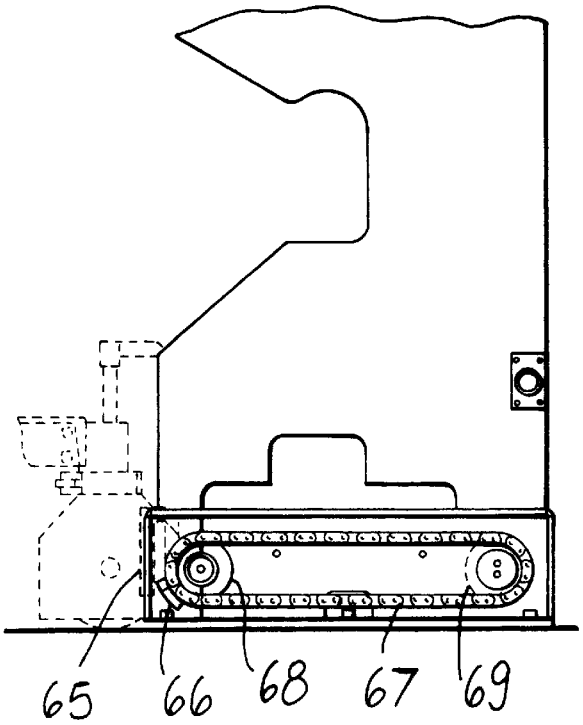
FIG. 10 is a side elevation view of a double driving chain system for the entry and exit of an on-off carriage or truck which can be arranged at the base of a printing station.
Figure 15:
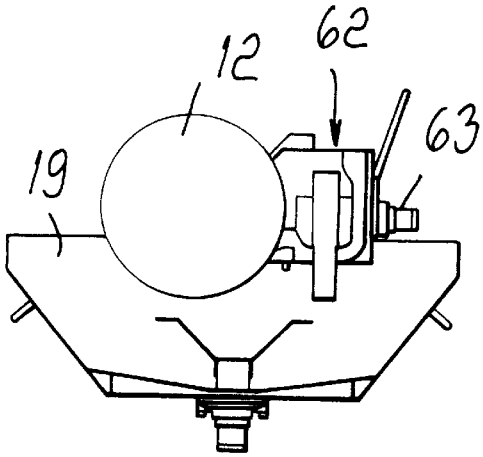
FIG. 15 is a cross-sectional view taken along the line XV—XV of FIG. 13.
Figure 11:
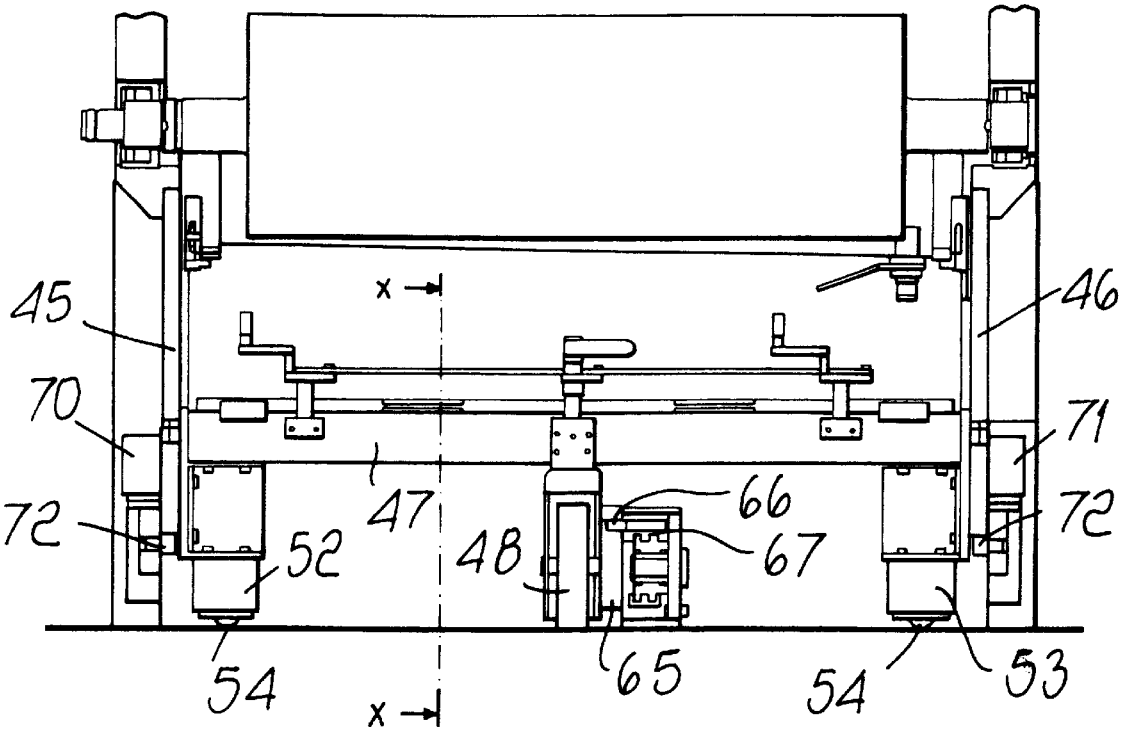
FIG. 11 is a front view of an on-off carriage which is inserted and raised between the two side shoulders with a single double-chain system which engages with the intermediate portion of the truck.
Figure 12:
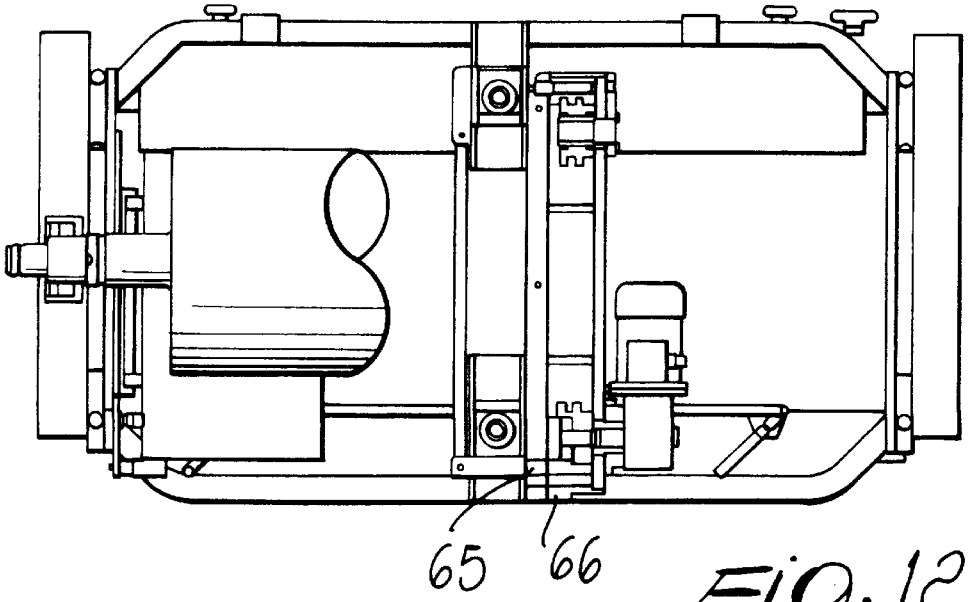
FIG. 12 is a partial cross-sectional top view, taken at three different levels, of the carriage or truck of FIG. 7.
Figure 13:
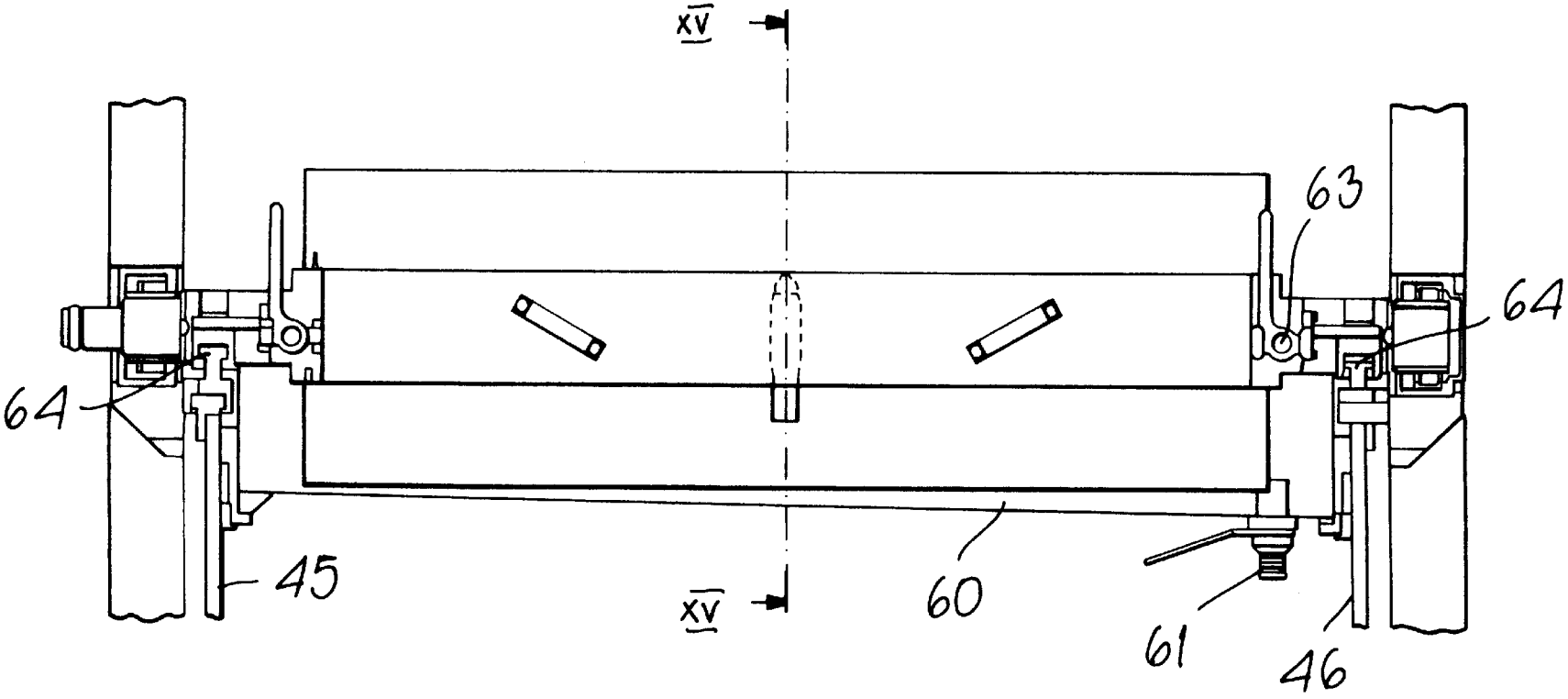
FIGS. 13 and 14 are, respectively, a front elevation and a plan view of an inking system installed on an on-off carriage.
Figure 14:
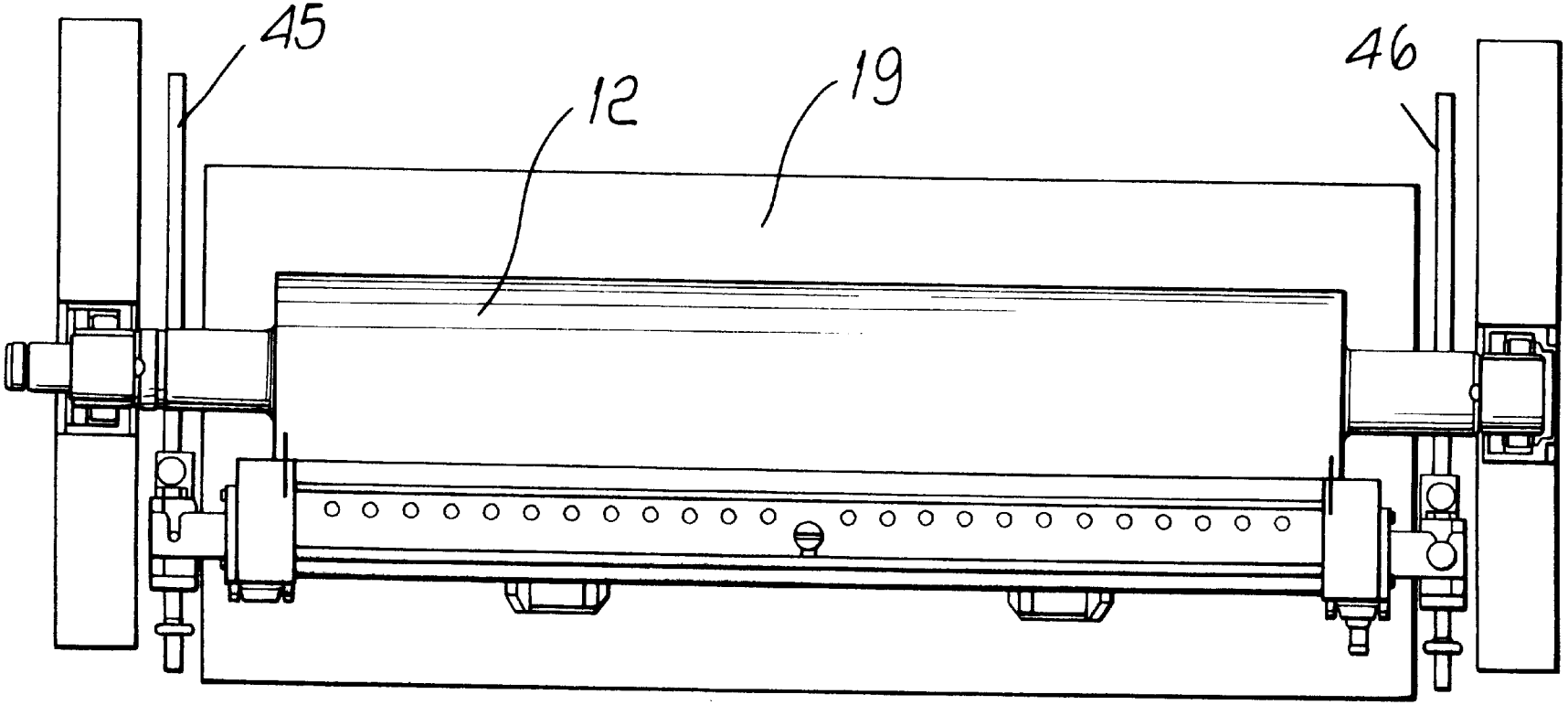

As shown in FIG. 10, at the lower portion of the lateral shoulders 45 and 46 or at one of the wheels 48, 49 the carriage or truck 41 has a fixed recess 65 designed to be engaged by a corresponding cantilevered pivot 66 supported by a portion, or by a respective portion, of a double chain 67 (FIG. 12), which is wound around a pair of chain sprocket wheels 68 and 69 and extends parallel to the shoulders 45 and 46. One of the sprocket wheels 68 and 69 is a driving wheel, so that when the carriage is arranged between the shoulders 4 and 5 of the printing station and the fixed recess or recesses 65 engages with the pivot or pivots 66, a sensor (not shown) detects correct positioning of the carriage and generates a control signal which causes the motor to start, thereby driving the driving sprocket wheel for the chains 67, and thus the carriage or truck is fully inserted in position inside the printing assembly and then locked in upward direction by means of two lateral hydraulic cylinders 70 and 71 which are arranged to engage two lateral pivots 72 of the carriage (see FIG. 11).

It will be easily noted that the carriage or truck 41 can be inserted in a printing unit in two different positions depending upon the print to be obtained. The carriage 41 is inserted with the doctor blade 42 being arranged on the inlet side for the tape material 8 to be printed (FIG. 2A) when direct rotogravure printing is to be performed, whereas the carriage 41 is inserted with its opposite front (FIG. 2B) when indirect rotogravure printing is to be obtained.

The above described invention is susceptible to numerous modifications and variations within the scope of protection as defined in the claims.

The disclosures in Italian Patent Application No. VR98A000008 from which this application claims priority are incorporated herein by reference.

What is claimed is:

1. A printing machine with rotogravure system, having at least one printing unit, a respective drying hood and a control unit, each printing unit comprising an orientatable inlet roller for material in tape form, a plurality of idle rollers for conveying the tape material, an upper pressure roller provided with a rubber sleeve, a lower pressure roller, a doctor blade assembly and an engraved printing cylinder, wherein a step motor is arranged to drive at least one of said upper pressure roller and said lower pressure roller, movably supported on linear guides at the ends thereof and pressure detecting means is provided to forward, to said control unit, signals indicating the linear pressure between the upper pressure roller, the lower pressure roller and the engraved printing cylinder.

2. The machine according to claim 1, wherein said pressure detecting means comprises at least one load cell provided with resistor-type straingauges.

3. The machine according to claim 1, wherein each step motor comprises a respective recirculating ballscrew abutting against a respective load cell.

4. The machine according to claim 1, comprising a removable on-off carriage arranged to be inserted into and removed from said printing unit and an engraved cylinder, and an inking assembly supported by said carriage.

5. The machine according to claim 4, wherein said carriage is arranged to be placed in said printing unit in two different configurations according to the printing or coating to be obtained.

6. The machine according to claim 4, wherein said carriage comprises a supporting structure, two wheels which are aligned and spaced from one another along the transverse centerline of said carriage, at least one of said wheels being manually steerable, two balls which are free to rotate, aligned along the longitudinal centerline of said carriage and arranged on the opposite side with respect to, and at a slightly shorter level than, said steerable wheels.

7. The machine according to claim 4, comprising lateral sliding blocks movable along vertical guides to support and vertically adjust said doctor blade, and being angularly adjustable about a horizontal pivot about which said doctor blade assembly is adjustable upon control of at least one linear actuator.

8. The machine according to claim 4, wherein said inking assembly comprises a vertically adjustable ink tray having an ink outlet discharging directly into a tank located below said engraved printing cylinder.

9. The machine according to claim 8, wherein said inking assembly which is arranged on the opposite side with respect to said printing cylinder and is adjustably mounted on horizontal guides to match various diameters of the engraved printing cylinder.

10. The machine according to claim 4, wherein said printing unit comprises an engagement means which is arranged to be driven by a portion, or by a respective portion, of at least one chain device, whose chain or chains are wound around a pair of chain sprocket wheels, one of said wheels being a driving sprocket wheel, and said carriage having, at the lower part of the ends thereof or at one of said steerable wheels, a grip means arranged to be engaged by said engagement means, whereby when the carriage is arranged in said printing unit and coupling between the grip means and the engagement means has occurred said carriage is fully inserted in position within the printing unit.

11. The machine according to claim 10, comprising a sensor arranged to detect correct positioning of said carriage in said printing unit and to generate a control signal to operate said chain device.

12. The machine according to claim 10, comprising a pair of linear actuators for upward locking said carriage once it is fully inserted in position in said printing unit.

13. The machine according to claim 1, comprising at least one station for spreading solvent- or water-based or UV inks, having an auxiliary pressure roller arranged to act against said upper pressure roller to improve the grip on the tape.

14. The machine according to claim 13, wherein said auxiliary pressure roller is mounted at one end of a pair of supporting arms, the other end of which is pivoted around a pivot which extends parallel to said upper and lower pressure rollers and is controlled by pressure means which act on said pair of arms.

15. The machine according to claim 14, wherein said pressure means comprises at least one cylinder-and-piston unit.

16. The machine according to claim 13, wherein the minimum gap between said upper and lower pressure rollers is between 0.01 and 0.5 mm.

* * * * *